US005750202A

United States Patent [19]

Romano et al.

[11] Patent Number: 5,750,202

[45] Date of Patent: May 12, 1998

[54] PREPARATION OF GOLD-COATED MOLYBDENUM ARTICLES AND ARTICLES PREPARED THEREBY

[75] Inventors: Timothy S. Romano; Tom K. Evans; Gary B. Hughes, all of Goleta; Karl H. Neumann, Santa Barbara, all of Calif.

[73] Assignee: Santa Barbara Research Center, Goleta, Calif.

[21] Appl. No.: 277,459

[22] Filed: Jul. 19, 1994

[51] Int. Cl.[6] ..... B05D 3/02

[52] U.S. Cl. ..... 427/376.4; 427/376.6

[58] Field of Search ..... 427/376.4, 376.6

[56] References Cited

U.S. PATENT DOCUMENTS

| | | | |
|---|---|---|---|
| 3,935,345 | 1/1976 | Lema | 427/383 |
| 4,266,000 | 5/1981 | Scherer | 174/52 FP |
| 4,649,229 | 3/1987 | Scherer | 174/52 FP |
| 5,198,154 | 3/1993 | Yokoyama et al. | 252/514 |

*Primary Examiner*—Benjamin Utech

*Attorney, Agent, or Firm*—W. C. Schubert; W. K. Denson-Low

[57] ABSTRACT

A gold-coated molybdenum article (30) is made by furnishing a substrate (32) made of pure molybdenum or an alloy of molybdenum, and preparing a slurry of gold powder, acrylic binder, and acetone liquid carrier. The slurry is applied to a portion of a surface of the substrate. The substrate with applied slurry is heated in vacuum or inert atmosphere to an elevated temperature, preferably about 2040° F., and thereafter cooled to ambient temperature. The result is an article (30) having at least a portion of the substrate (32) covered with an adherent gold coating (34).

16 Claims, 1 Drawing Sheet

PREPARATION OF GOLD-COATED MOLYBDENUM ARTICLES AND ARTICLES PREPARED THEREBY

BACKGROUND OF THE INVENTION

This invention relates to applying a layer of gold to the surface of a molybdenum article.

Molybdenum pins are used to conduct electrical signals in certain types of electrical feedthroughs. The molybdenum pins are bonded into a feedthrough plate structure, leaving both ends free. Electrical wires are connected to one or both ends of the molybdenum pins, as by wire bonding or soldering.

It is not possible to securely bond electrical wires directly to molybdenum. To facilitate bonding, it is a known practice to coat at least the ends of the molybdenum pin with a coating of gold, typically about 0.0003 inches thick. The gold is applied to the molybdenum. The wires are readily soldered, or otherwise bonded, to the gold-coated molybdenum, inasmuch as the gold is resistant to the formation of an oxide barrier.

There are several known techniques for applying the gold coating to the molybdenum surface, including electroplating and vapor deposition techniques such as sputtering. While operable to transfer gold to the molybdenum surface, these known techniques tend to produce poor, non-metallurgical quality bonds between the gold and the molybdenum. After attachment of the wires and during service, failure often occurs at the gold-molybdenum interface due to the poor bond. Additionally, the deposition techniques have economic drawbacks. The electrodeposition of gold produces waste product solutions that must be processed before disposal to remove excess gold and environmentally detrimental agents. Vapor deposition techniques are often wasteful of the expensive gold, as they deposit gold on surfaces other than the intended molybdenum surface. Also, it is difficult to coat small, non-planar articles such as pins with an even coating only in particular regions. Both approaches require careful masking to ensure that gold is deposited only in the desired regions of the molybdenum article.

Accordingly, there is a need for an improved approach for depositing a highly adherent gold coating onto molybdenum. The present invention fulfills this need, and further provides related advantages.

SUMMARY OF THE INVENTION

The present invention provides an approach for depositing a highly adherent gold coating onto at least a portion of a molybdenum surface. The process is economical, in that gold is deposited only where needed without the need for masking of the other regions. Small or irregular surfaces are as readily coated with gold as planar surfaces, and various types of articles can be processed together. There is no loss of gold in waste solutions or by inefficient deposition, and there are no waste products that must be processed for disposal. Tests demonstrate that the gold coating on molybdenum is more adherent and resistant to failure during service than gold coatings produced by other techniques.

In accordance with the invention, a method for preparing a gold-coated article comprises the steps of furnishing a substrate made of a material selected from the group consisting of pure molybdenum and an alloy of molybdenum. The method further includes preparing a slurry of gold powder, a binder such as an acrylic, and a liquid carrier such as acetone. The slurry is applied to a portion of a surface of the substrate that is to be coated with gold, as by brushing, spraying, dipping, or other suitable technique. The substrate with applied slurry is heated in vacuum or a partial pressure of an inert gas to an elevated temperature sufficient to melt the gold to form a gold-coated article, typically about 2040° F. for 1½ minutes, and thereafter cooled to ambient temperature.

This approach permits a uniform, controllable gold coating to be applied to a molybdenum surface. Large or small numbers of parts can be coated at once, and various types of parts can be coated together without separate setups. Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
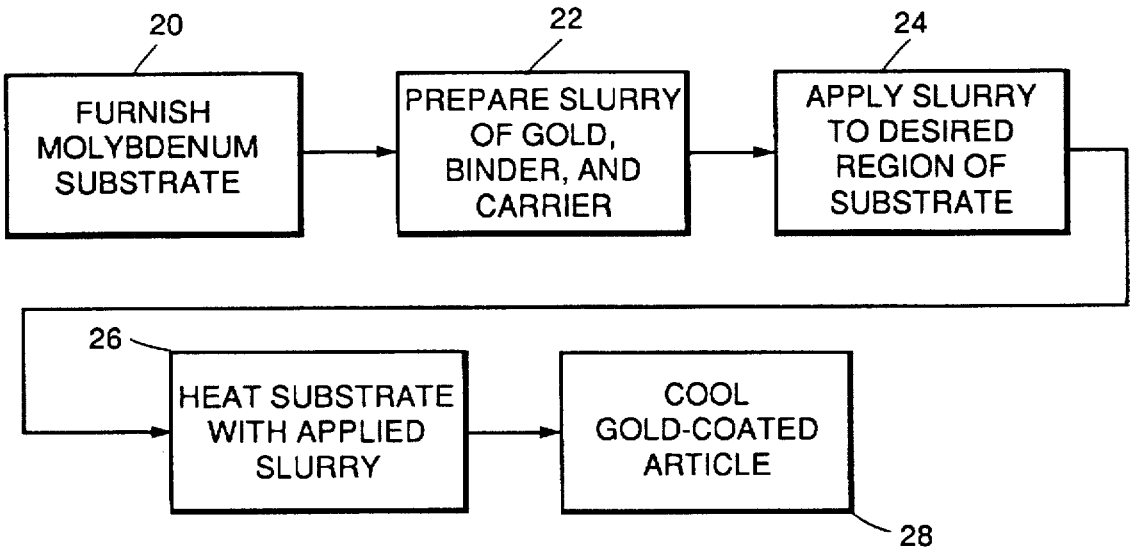
FIG. 1 is a flow chart of a preferred process for coating a molybdenum article with gold.
Figure 2:
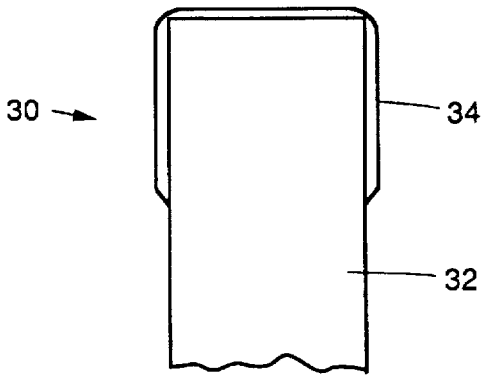
FIG. 2 is an sectional view through a gold-coated molybdenum article.

FIG. 1 depicts a preferred approach for practicing the invention, and FIG. 2 shows a finished gold-coated article 30 prepared according to the invention. Referring to FIG. 1, the process begins by furnishing a substrate 32, numeral 20. At least the portion of the substrate 32 that is to be coated with gold is made of molybdenum. As used herein, "molybdenum" includes both pure molybdenum and molybdenum alloys. The coating of non-planar articles of molybdenum with gold presents some difficult problems. Non-planar articles cannot be readily coated by sputtering. Molybdenum is more difficult to electroplate than many other candidate connector materials.

The substrate 32 may be of any shape, including flat, curved, irregular, and other shapes. In the preferred application of the invention, the substrate 32 is a cylindrical pin used in an electrical feedthrough. This substrate is about 0.018 inches in diameter and 0.320 inches long, but the invention is not so limited. Molybdenum is desirably used as a feedthrough pin because of its low coefficient of thermal expansion and high stiffness.

A slurry of gold particulate, a binder, and a volatile carrier liquid is prepared, numeral 22. The gold may be pure gold (99.99 percent purity) or a gold alloy. It is furnished as a finely divided powder, preferably from about −140 to about −325 mesh (i.e., −140+325 mesh). Larger and smaller sizes of gold powders are operable, but trials have demonstrated that the indicated size range gives the best results in terms of a workable slurry consistency for application by brush or automated techniques. The gold can also be furnished as a commercial paste containing gold particles.

The binder is preferably an acrylic polymer-containing liquid. Most preferably, the binder is a solution of 6 percent acrylic, 2 percent cyclic ether, balance 1,1,1 trichloroethane. Such a binder material is available commercially from Wall Colmonoy, Detroit, Mich.

The carrier is preferably acetone, but other carrier liquids may be used.

The gold particulate, binder, and carrier are mixed together to produce the required amount of slurry. The amount of binder is sufficient to adhere the gold particulate to the surface of the molybdenum after the carrier evaporates but before the substrate and gold have been heated above the melting point of gold. The amount of carrier is sufficient to give the slurry a desired consistency for application, depending upon the selected application technique. In a preferred embodiment, the slurry contains about 90±5 parts by volume of gold powder, about 8±5 parts by volume of acrylic-containing binder, and about 2±1 parts by volume of acetone liquid carrier, with the total being 100 parts by volume. This mixture produces a slurry having a consistency like that of flowing wet sand, and is suitable for application by brushing or automatic dispensing. A paste of thicker consistency is prepared by reducing the relative amounts of binder and carrier within the indicated ranges.

After preparation, the slurry is applied to the portion of the substrate 32 that is to be coated, numeral 24. It may be the case that the entire substrate is to be coated, or in other instances only a portion of the substrate is to be coated. An advantage of the present invention is that the slurry may be applied by any suitable technique, such as brushing, screening, spraying, dispensing manually or automatically from a syringe, or dipping, to local areas of the surface of the substrate with or without the use of masks. In the case of the coating of the ends of the molybdenum feedthrough pins, the slurry can be readily painted onto the ends with a small brush. The coating should be reasonably even, but another virtue of the invention is that the subsequent melting of the gold causes it to flow locally on the surface and even out any irregularities in the applied coating. While a mask is not required, a mask may be used if intricate patterns in the gold coating are desired.

After the slurry is applied to the surface of the substrate 32, the slurry is permitted to dry at ambient temperature by evaporation of the volatile carrier liquid. The drying requires only a few minutes. Incomplete drying does not adversely affect the final product, as any remaining carrier liquid is evaporated in the subsequent heating.

The substrate and its applied slurry are heated to elevated temperature, numeral 26. The elevated temperature that is ultimately reached in the heating procedure is above the melting point of gold, and is preferably from about 2030° F. to about 2050° F., most preferably about 2040° F. The gold need remain at this temperature only briefly, and a time of about 1½ minutes is preferred. The gold in the applied slurry is thereby melted so that it can flow over the surface of the substrate 32 to form a uniform layer and bond metallurgically to the underlying substrate 32. This flowing and bonding is important, as it produces a uniform coating that is tightly bonded to the substrate.

The metallurgically bonded coating produced by the present approach is distinct from that produced by prior techniques such as electroplating and vapor deposition techniques such as sputtering. These prior techniques produce a gold layer which is, at best, weakly bonded to the substrate. The approach is also distinct from a possible technique wherein the gold coating is heated to temperatures below the melting point of gold to sinter the gold particles together. Such a sintered coating would not have the strength and adherence of the melted gold coating.

In the preferred heating step 26, the substrate and its applied gold-containing layer are placed into a vacuum furnace, and the interior of the furnace is evacuated to a vacuum of less than about $5\times10^{-5}$ Torr. The use of a vacuum prevents the formation of a thick oxide coating on the molybdenum substrate during the heating so that no flux is required. Alternatively, the heating may be conducted in a partial pressure of an inert gas. For example, the heating could be conducted in a pressure of from about $10^{-3}$ to about $10^{-2}$ Torr of argon or nitrogen.

Even though a vacuum is applied to the melted gold layer, the temperature is not far above the melting point of gold, the time of exposure above the melting point is quite short, and the vapor pressure of the gold is not so high under these conditions that there is a significant vaporization of gold. Thus, virtually all of the gold mixed into the slurry is conducted to the surface of the substrate, at the location where it is desired. Little, if any, gold is lost, and there is virtually no cleanup or disposal of waste products required.

The substrate and the applied gold-containing layer are heated in a controlled manner from ambient temperature to above the melting point of gold. The heating rate is typically about 65° F. per minute. Preferably, the temperature is held at selected intermediate values to permit equilibration and to permit the binder to be vaporized and drawn away so that it cannot be entrapped in the final coating. The preferred intermediate holding temperatures are 1100° F. for 15 minutes and 1800° F. for 5 minutes. When the temperature reaches the selected maximum temperature above the melting point of gold, here 2040° F., the temperature is maintained for a relatively short time, preferably about 1½ minutes. This time is sufficient to permit the gold to melt and fuse together in a continuous coating, flow sufficiently to form a coating of uniform thickness, and metallurgically bond to the substrate.

After the heating procedure is complete, the substrate and its gold coating are cooled to ambient temperature, numeral 28. Cooling is preferably accomplished by turning off the power to the heating coils of the vacuum furnace and permitting the substrate and gold coating to cool to ambient temperature.

The final structure is depicted in FIG. 2, with a uniform gold coating 34 on the substrate 32. The thickness of the gold coating 34 can be varied by changing the thickness of the initially applied slurry coating in step 24. Generally, the gold coating ranges from about 0.0005 inches to about 0.002 inches thick, and is most preferably about 0.0008 inches thick for the preferred case of the gold-coated molybdenum feedthrough pin.

Specimens of the gold-coated molybdenum feedthrough pin have been successfully fabricated by the approach just described. Wire bonding, tab bonding, and soft and hard soldering to the gold-coated region of the feedthrough pin were successfully accomplished. Mechanical strength tests were performed on wires fixed to the feedthrough pin by wire bonding. Pull strengths ranged from 25 to 42 grams for a 0.001 inch diameter gold wire bonded to the gold layer 34, and failure occurred in the wire rather than in the gold or at the gold-molybdenum or gold-wire interfaces. By comparison, pull strengths for wires bonded to gold-coated molybdenum pins prepared by other techniques typically range from 3 to 15 grams, and failure usually occurs at the gold-molybdenum interface. The failure in the wire of specimens prepared by the present approach indicates that the gold, gold-molybdenum interface, and gold-wire interface are stronger than the wire and are no longer the limiting factor in the strength of the bonded structure.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for preparing a gold-coated article, comprising the steps of:

furnishing a substrate made of a material selected from the group consisting of pure molybdenum and an alloy of molybdenum;

preparing a slurry of gold powder, a binder, and a liquid carrier;

applying the slurry to a portion of a surface of the substrate;

heating the substrate with applied slurry in vacuum to an elevated temperature sufficient to melt the gold to form a gold-coated article; and cooling the gold-coated article to ambient temperature.

2. The method of claim 1, wherein the step of preparing a slurry includes the step of providing an acrylic binder.

3. The method of claim 1, wherein the step of preparing a slurry includes the step of providing acetone as the liquid carrier.

4. The method of claim 1, wherein the step of heating the substrate with applied slurry includes the step of heating the substrate with applied slurry to a temperature of about 2040° F.

5. The method of claim 1, wherein the step of heating the substrate with applied slurry includes the step of heating the substrate with applied slurry at a heating rate of about 65° F. per minute.

6. The method of claim 1, wherein the step of heating the substrate with applied slurry includes the step of holding the substrate with applied slurry at intermediate temperatures of about 1100° F. and about 1800° F. during the step of heating.

7. The method of claim 1, wherein the step of heating the substrate with applied slurry includes the step of applying a vacuum of about $5\times10^{-5}$ Torr during the step of heating.

8. The method of claim 1, wherein the step of heating the substrate with applied slurry is performed in a vacuum furnace, and wherein the step of cooling the gold-coated article includes the step of discontinuing power to the furnace and permitting the gold-coated article to furnace cool.

9. The method of claim 1, wherein the step of furnishing a substrate includes the step of furnishing a substrate shaped as a cylindrical pin.

10. The method of claim 1, wherein the step of preparing a slurry includes the steps of providing about 90 parts by volume of gold powder, about 8 parts by volume of binder, and about 2 parts by volume of liquid carrier.

11. The method of claim 1, wherein the step of preparing a slurry includes the step of providing gold powder having a size of from about −140 to about −325 mesh.

12. The method of claim 1, including the additional step, after the step of cooling, of bonding a bonded component to the gold-coated portion of the gold-coated article.

13. The method of claim 1, wherein the step of applying includes the step of brushing the slurry onto the portion of the surface of the substrate.

14. The method of claim 1, wherein the step of applying includes the step of dispensing the slurry onto the portion of the surface of the substrate.

15. A method for preparing a gold-coated article, comprising the steps of:

furnishing a substrate made of a material selected from the group consisting of pure molybdenum and an alloy of molybdenum;

preparing a slurry of gold powder, an acrylic-containing fluid, and acetone;

applying the slurry to a portion of a surface of the substrate;

heating the substrate with applied slurry in vacuum to an elevated temperature of from about 2030° F. to about 2050° F. to form a gold-coated article; and cooling the gold-coated article to ambient temperature.

16. The method of claim 15, wherein the step of heating includes the step of holding the substrate with applied slurry at the elevated temperature of from about 2030° F. to about 2050° F. for about one and one half minutes.

* * * * *